US011345531B2

(12) United States Patent
Swenson

(10) Patent No.: US 11,345,531 B2
(45) Date of Patent: May 31, 2022

(54) PACKAGING SLEEVE AND METHOD OF RETAINING A PLURALITY OF INDIVIDUALLY PACKAGED PRODUCTS

(71) Applicant: General Mills, Inc., Minneapolis, MN (US)

(72) Inventor: Anthony W Swenson, Blaine, MN (US)

(73) Assignee: General Mills, Inc., Minneapolis, MN (US)

( * ) Notice: Subject to any disclaimer, the term of this patent is extended or adjusted under 35 U.S.C. 154(b) by 486 days.

(21) Appl. No.: 16/244,651

(22) Filed: Jan. 10, 2019

(65) Prior Publication Data

US 2020/0223612 A1 Jul. 16, 2020

(51) Int. Cl.
*B65D 77/04* (2006.01)
*B65B 27/04* (2006.01)
(Continued)

(52) U.S. Cl.
CPC ..... *B65D 77/0413* (2013.01); *B65B 11/004* (2013.01); *B65B 27/04* (2013.01);
(Continued)

(58) Field of Classification Search
CPC ..... B65B 11/004; B65B 27/04; B65D 71/20; B65D 71/22; B65D 75/02; B65D 75/52;
(Continued)

(56) References Cited

U.S. PATENT DOCUMENTS 2,069,742 A * 2/1937 Kelth ..... B65D 71/0055 206/168
2,182,065 A * 12/1939 Warren ..... B65D 71/0055 206/142

(Continued)

OTHER PUBLICATIONS

Kumaresan. M, Effect of fiber orientation on mechanical properties of sisal reinforced epoxy composites, Journal of Applied Science and Engineering, vol. 18, No. 3, pp. 289-294 (2015) (Year: 2015).*

(Continued)

*Primary Examiner* — Robert F Long
*Assistant Examiner* — Eduardo R Ferrero
(74) *Attorney, Agent, or Firm* — Diederiks & Whitelaw, PLC; Annette M. Frawley, Esq.

(57) ABSTRACT

A packaging sleeve for retaining a plurality of individually packaged products includes a first sidewall having a first opening that partially receives a first product of the plurality of individually packaged products, as well as a reinforcing biasing beam that exhibits a spring action to bias the first product into the first opening by applying a force to the first product in a direction toward the first opening. The biasing beam includes a first wall and a second wall, with the first wall of the biasing beam contacting and biasing the first product, and the second wall of the biasing beam contacting a second product and biasing the second product into a second opening formed in the sleeve. The biasing beam is convertible between a fully compressed state and a fully expanded state, with the biasing beam being biased to the fully expanded state.

17 Claims, 11 Drawing Sheets

(51) Int. Cl.

| | |
|---|---|
| ***B65D 75/02*** | (2006.01) |
| ***B65B 11/00*** | (2006.01) |
| *B65D 75/52* | (2006.01) |
| *B65D 1/20* | (2006.01) |
| *B65D 71/20* | (2006.01) |

(52) U.S. Cl.
CPC ..... *B65D 75/02* (2013.01); *B65D 71/20* (2013.01); *B65D 75/52* (2013.01); *B65D 2571/0066* (2013.01); *B65D 2571/00277* (2013.01); *B65D 2571/00283* (2013.01); *B65D 2571/00302* (2013.01); *B65D 2571/00716* (2013.01)

(58) Field of Classification Search
CPC ..... B65D 77/0413; B65D 2571/00141; B65D 2571/00277; B65D 2571/00283; B65D 2571/00302; B65D 2571/0066; B65D 2571/00716; B65D 2571/00845; B65D 71/24; B65D 71/40; B65D 2571/00271; B65D 2571/00722
See application file for complete search history.

(56) References Cited

U.S. PATENT DOCUMENTS 2,304,683 A * 12/1942 Finn ..... B65D 71/0051 206/172
2,313,731 A * 3/1943 Brogden ..... B65D 71/38 206/428
2,345,565 A * 4/1944 Arneson ..... B65D 71/0037 206/175
2,345,566 A * 4/1944 Arneson ..... B65D 71/0037 206/195
2,345,567 A * 4/1944 Arneson ..... B65D 71/0044 206/176
2,345,568 A * 4/1944 Arneson ..... B65D 71/004 206/171
2,362,995 A * 11/1944 Gilbert ..... B65D 71/0051 206/170
2,364,650 A * 12/1944 Powell ..... B65D 71/0037 206/195
2,373,851 A * 4/1945 Potter ..... B65D 71/004 206/165
2,375,056 A * 5/1945 Wesselman ..... B65D 71/0059 206/164
2,421,850 A * 6/1947 Ringler ..... B65D 71/004 206/189
2,491,149 A * 12/1949 Arneson ..... B65D 71/0037 206/196
2,505,399 A * 4/1950 Hilton ..... B65D 71/125 206/756
2,537,615 A * 1/1951 Arneson ..... B65D 71/0025 206/173
2,656,959 A * 10/1953 Currie ..... B65D 71/26 206/154
2,701,661 A * 2/1955 Murray ..... B65D 71/30 206/154
2,731,776 A * 1/1956 Currie ..... B65D 71/20 53/398
2,765,073 A * 10/1956 Murray ..... B65D 71/16 206/434
2,818,171 A * 12/1957 Noble ..... B65D 71/20 206/152
2,867,320 A * 1/1959 Noble ..... B65D 71/20 206/140
2,877,894 A * 3/1959 Forrer ..... B65D 71/16 206/168
2,911,096 A * 11/1959 Noble ..... B65D 71/26 206/434
2,926,782 A * 3/1960 Noble ..... B65D 71/26 206/142
2,975,891 A * 3/1961 Stone ..... B65D 71/20 206/434
3,006,530 A * 10/1961 Forrer ..... B65D 71/26 206/154
3,029,999 A * 4/1962 De Paul ..... B65D 71/246 206/196
3,061,141 A * 10/1962 Cote ..... B65D 71/30 206/196
3,098,583 A * 7/1963 Sherman ..... B65D 71/34 206/140
3,107,465 A * 10/1963 Cote ..... B65D 71/20 53/398
3,120,903 A * 2/1964 Cote ..... B65D 71/20 206/140
3,128,010 A * 4/1964 Forrer ..... B65D 71/26 206/155
3,129,843 A * 4/1964 Weiss ..... B65D 71/26 206/140
3,157,309 A * 11/1964 Chidsey, Jr. ..... B65D 71/32 206/155
3,163,321 A * 12/1964 Weiss ..... B65D 71/26 206/196
3,166,228 A * 1/1965 Weiss ..... B65D 71/16 206/196
3,182,794 A * 5/1965 Moore ..... B65D 71/32 229/161
3,194,478 A * 7/1965 Weiss ..... B65D 71/32 206/196
3,216,612 A * 11/1965 Chidsey, Jr. ..... B65D 71/32 206/154
3,229,892 A * 1/1966 Weiss ..... B65D 71/20 206/152
3,248,004 A * 4/1966 Weiss ..... B65D 71/26 206/140
3,248,036 A * 4/1966 Weiss ..... B65D 71/246 206/196
3,263,893 A * 8/1966 Weiss ..... B65D 71/246 206/196
3,326,367 A * 6/1967 Weiss ..... B65D 71/32 206/154
3,337,043 A * 8/1967 Parker ..... B65D 71/32 206/161
3,352,453 A * 11/1967 Weiss ..... B65D 71/16 206/140
3,390,763 A * 7/1968 Weiss ..... B65D 71/34 206/149
3,432,029 A * 3/1969 Brown ..... B65D 71/16 206/140
3,498,449 A * 3/1970 Spery ..... B65D 71/26 206/148
3,640,448 A * 2/1972 Wood ..... B65D 71/32 206/158
3,680,765 A * 8/1972 Harrelson ..... B65D 71/32 206/145
3,692,228 A * 9/1972 Spiegel ..... B65D 71/34 206/486
3,692,232 A * 9/1972 Helms ..... B65D 5/4608 229/940
3,807,624 A * 4/1974 Funkhouser ..... B65D 71/36 229/940
4,254,173 A * 3/1981 Peer, Jr. ..... B32B 27/16 428/204
4,463,852 A * 8/1984 Stone ..... B65D 71/0014 206/141
4,498,581 A * 2/1985 Dutcher ..... B65D 71/36 206/427
4,703,847 A * 11/1987 Oliff ..... B65D 71/16 206/140
5,048,676 A * 9/1991 Borgis ..... B65D 71/16 206/419
5,188,273 A * 2/1993 Schmoock ..... B65H 23/0256 226/190
5,201,412 A * 4/1993 Schuster ..... B65D 71/44 206/153
5,605,228 A * 2/1997 Baxter ..... B65D 71/16 206/427

(56) References Cited

U.S. PATENT DOCUMENTS 5,638,956 A * 6/1997 Sutherland ..... B65D 71/20 206/147
5,765,685 A * 6/1998 Roosa ..... B65D 71/16 206/434
5,984,086 A * 11/1999 Foushee ..... B65D 71/16 206/147
6,039,181 A * 3/2000 Whiteside ..... B65D 71/125 206/427
6,338,864 B1 * 1/2002 Deering ..... B65D 3/22 229/122.32
7,468,498 B2 12/2008 Tuszkiewicz et al.
7,721,878 B2 * 5/2010 Requena ..... B65D 71/46 206/148
8,056,709 B2 * 11/2011 Sutherland ..... B65D 71/46 206/148
8,114,253 B2 * 2/2012 Jez ..... G01N 33/346 162/263
9,139,336 B2 * 9/2015 Jego ..... B65B 5/06
9,205,948 B1 * 12/2015 Block ..... B65D 5/4208
9,677,224 B2 * 6/2017 Faufau ..... D21F 1/486
9,751,671 B2 * 9/2017 Dillon ..... B65D 71/14
10,633,159 B2 * 4/2020 Jego ..... B65D 71/18
2003/0168503 A1 * 9/2003 Collura ..... B65D 71/36 229/125.19
2003/0178335 A1 * 9/2003 Ichikawa ..... B65D 77/0413 206/391
2004/0151929 A1 * 8/2004 Cosentino ..... B32B 27/36 428/479.6
2007/0163918 A1 * 7/2007 Klatt ..... A61J 1/03 206/538
2011/0233091 A1 * 9/2011 Block ..... B65D 71/30 206/427
2012/0138489 A1 * 6/2012 Holley, Jr. ..... B65D 71/42 206/153
2013/0313296 A1 * 11/2013 Stewart ..... A45C 11/00 224/218
2016/0009442 A1 * 1/2016 Block ..... B65D 71/30 206/141
2016/0101915 A1 * 4/2016 Meighen ..... B65B 11/004 53/441
2016/0347497 A1 * 12/2016 Novotny ..... B65D 5/324
2017/0096750 A1 * 4/2017 Zhang ..... D01F 9/12
2017/0233131 A1 * 8/2017 Nielsen ..... B65D 71/36 206/427
2017/0233132 A1 * 8/2017 Smalley ..... B65D 5/4266 206/427
2018/0029768 A1 * 2/2018 Blin ..... B65D 5/4266
2018/0044086 A1 * 2/2018 Patwardhan ..... B65D 5/4608
2018/0134443 A1 * 5/2018 Ball ..... B65D 71/36
2020/0000140 A1 * 1/2020 Zappoli ..... B65H 27/00

OTHER PUBLICATIONS

Grain Direction,—The Long and Short of It, Brian Cowie, The Paper Mill Store, Mar. 19, 2018 (Year: 2018).*
Paper Tips: Going Against the Grain, Sabine Lenz, Creative PRO, Jun. 16, 2006 (Year: 2006).*

* cited by examiner

PACKAGING SLEEVE AND METHOD OF RETAINING A PLURALITY OF INDIVIDUALLY PACKAGED PRODUCTS

BACKGROUND OF THE INVENTION

The present invention pertains to the art of food production and, more particularly, to packaging for food products.

Food products are often packaged prior to sale. Such packaging can take the form of cans, jars, boxes or bags, for example. In some instances, after being individually packaged, multiple food products are then packaged together for sale. This can make it easier for consumers to purchase and store larger quantities of the food product. However, it is often the case that, once opened to remove one food product, this outer packaging does not remain intact, which can make it difficult for consumers to conveniently handle the remaining food products. Specifically, for canned or jarred products, the products may be held together within a paperboard sleeve that is constructed such that the consumer must tear the sleeve to remove the first can or jar. Once torn, there is nothing to prevent further cans or jars from exiting the sleeve. Accordingly, it would be desirable to provide a sleeve for such products that allows individual cans or jars to be removed from the sleeve without affecting the ability of the sleeve to retain the remaining cans or jars. It would also be desirable for the products within the sleeve to be visible from outside the sleeve. This improves a consumer's first impression by allowing the consumer to easily identify the overall product being sold, as well as see the number and size of the individual products.

SUMMARY OF THE INVENTION

The present invention achieves the above goals by providing a packaging sleeve for holding a plurality of products, with the packaging sleeve including a biasing beam and a plurality of product exposing openings. The biasing beam applies a force to the products held by the sleeve so that each product is retained within a corresponding one of the plurality of openings. The biasing beam also reinforces the sleeve to help prevent deformation of the sleeve. As a result, the products are securely retained within the sleeve, with the openings allowing the products to be easily seen from outside the sleeve.

In particular, the sleeve comprises at least a sidewall and the biasing beam. The sidewall includes the plurality of openings, each opening being configured to partially receive an individually packaged product. The biasing beam is configured to exhibit a spring action to bias the products into the openings by applying a force to the products in a direction toward the openings. A consumer can remove a product from the sleeve by applying a force to the product in the opposite direction. This compresses the biasing beam, providing more room for the product to move within the sleeve without the need to tear the sleeve (or otherwise compromise the sleeve's ability to retain further products).

Additional objects, features and advantages of the invention will become more readily apparent from the following detailed description of preferred embodiments thereof when taken in conjunction with the drawings wherein like reference numerals refer to common parts in the several views.

DETAILED DESCRIPTION OF THE INVENTION

Detailed embodiments of the present invention are disclosed herein. However, it is to be understood that the disclosed embodiments are merely exemplary of the invention that may be embodied in various and alternative forms. The figures are not necessarily to scale, and some features may be exaggerated or minimized to show details of particular components. Therefore, specific structural and functional details disclosed herein are not to be interpreted as limiting but merely as a representative basis for teaching one skilled in the art how to construct and employ the present invention.

As discussed above, when individually packaged products are packaged together, it is often the case that the outer packaging does not remain intact after being opened to remove one of the products. This can make it difficult for consumers to conveniently handle the remaining products. For example, canned or jarred products can be held together within a paperboard sleeve that is constructed such that the consumer must tear the sleeve to remove the first can or jar. Once torn, there is nothing to prevent further cans or jars from exiting the sleeve. The present invention was developed to address this problem. Specifically, the present invention provides a sleeve that is configured to retain a plurality of individually packaged products using an internal biasing beam and a plurality of openings in the sidewalls of the sleeve. The biasing beam applies a force to each product to retain each of the products in a respective opening. When a consumer wishes to remove a product, the consumer applies a force to the product in a direction opposite the force applied by the biasing beam. This compresses the biasing beam and provides enough room for the product to be slid out of the sleeve without the need to permanently deform (e.g., tear) the sleeve. Afterwards, the biasing beam expands to hold the remaining products in their openings.

Figure 1:
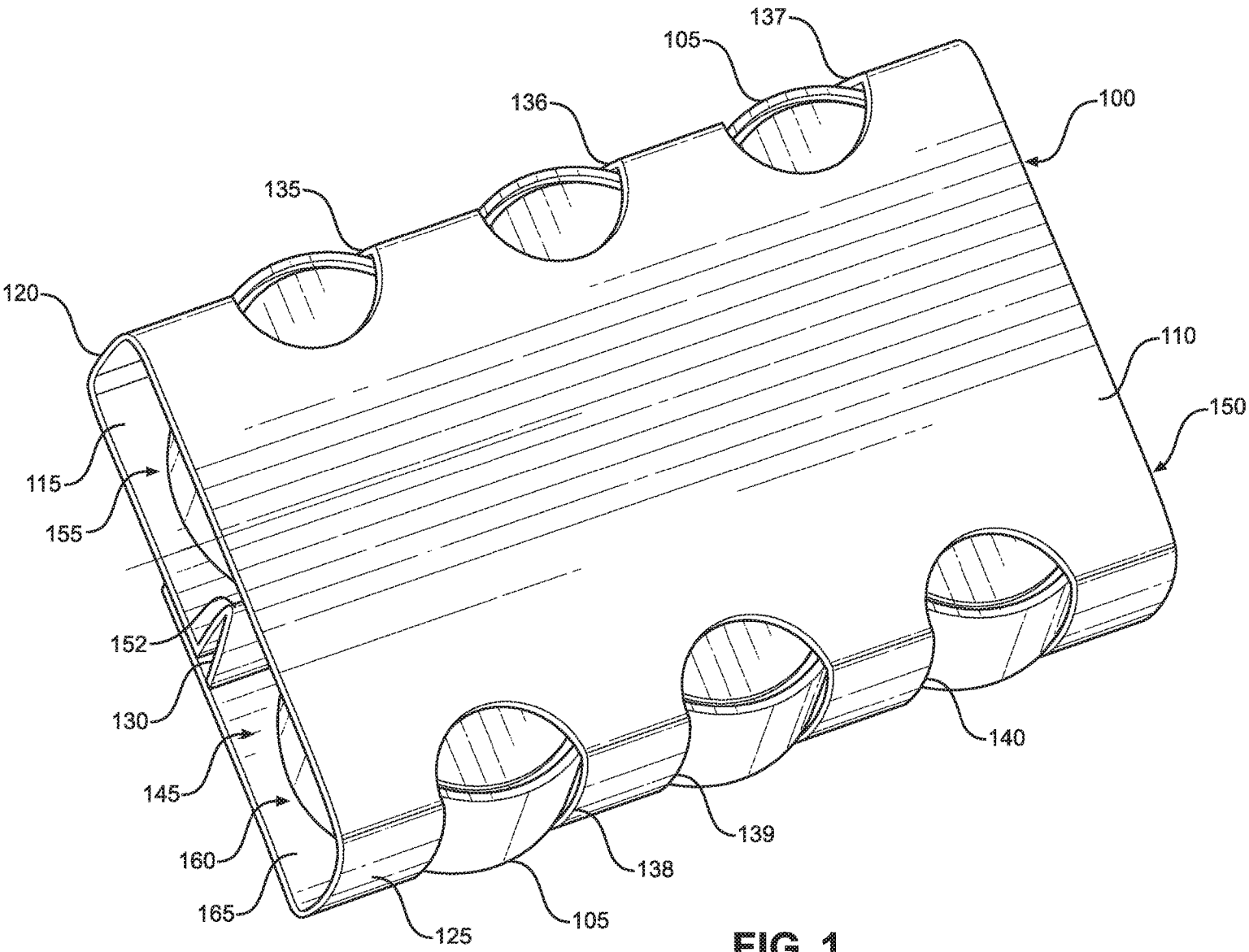
FIG. 1 is a perspective view of a packaging sleeve constructed in accordance with the present invention, with the packaging sleeve holding a plurality of cans.

With reference to FIG. 1, a packaging sleeve 100, constructed in accordance with the present invention, is shown. Sleeve 100 is configured to retain a plurality of individually packaged products 105. That is, sleeve 100 is constructed such that products 105 will not exit sleeve 100 due to gravity alone. In the embodiment illustrated, products 105 take the form of cans. However, sleeve 100 can be configured to hold other types of individually packaged products, such as jars. Together, sleeve 100 and products 105 constitute a retail packaged product that is sold to consumers (typically through an intermediary, such as a grocery store). In other words, sleeve 100 is not meant as bulk packaging, which is only used during transportation of goods from a manufacturer to a distributor or retail store. Preferably, sleeve 100 is constructed from paperboard. However, other materials can be used.

As shown, sleeve 100 includes a top wall 110, a bottom wall 115, a first sidewall 120, a second sidewall 125 and a biasing beam 130. Top wall 110 and bottom wall 115 connect first sidewall 120 and second sidewall 125 to one another. In addition, bottom wall 115 is configured to supports products 105. First sidewall 120 includes a plurality of openings 135-137, while second sidewall 125 includes a correspondingly arranged plurality of openings 138-140. Each of openings 135-140 is configured to partially receive one of products 105. Biasing beam 130 is configured to bias products 105 into openings 135-140 by applying a force to each of products 105 in a direction toward a respective opening 135-140, thereby holding products 105 in openings 135-140 such that sleeve 100 can effectively retain products 105. Although openings 135-140 are shown extending into top wall 110, this is not required to achieve the desired retention of products 105. Instead, this is done so that consumers can see more of products 105. The increased product visibility afforded by openings 135-140 is highly desirable and provides an advantage to sleeve 100 over an alternative, solid six-walled package.

Top wall 110, bottom wall 115, first sidewall 120 and second sidewall 125 together define a first end opening 145 and a second end opening 150 through which products 105 can be removed. Biasing beam 130 extends from first end opening 145 to second end opening 150 and is convertible, as will be detailed more fully below, between a fully compressed state and a fully expanded state. Biasing beam 130 is biased to the fully expanded state. In other words, the default state of biasing beam 130, when no external forces are applied to biasing beam 130, is the fully expanded state. The tendency of biasing beam 130 to return to the fully expanded state is how biasing beam 130 applies force to products 105. Specifically, biasing beam 130 is configured to exhibit a spring action outward toward openings 135-140. In a preferred embodiment, this is accomplished by orienting the fibers of the paperboard from which sleeve 100 is constructed so that the fibers cross a bend or fold 152 in biasing beam 130.

Top wall 110, bottom wall 115, first sidewall 120 and biasing beam 130 together define a first zone 155. Similarly, top wall 110, bottom wall 115, second sidewall 125 and biasing beam 130 together define a second zone 160. Stated differently, top wall 110, bottom wall 115, first sidewall 120 and second sidewall 125 together define an interior 165 of sleeve 100, and biasing beam 130 divides interior 165 into first zone 155 and second zone 160. In the embodiment illustrated, half of products 105 are retained in first zone 155, while the other half are retained in second zone 160. When biasing beam 130 is in the fully expanded state, the width of each zone 155, 160 is less than the width of a given product 105 (or a row of products 105). Accordingly, products 105 are partially received in openings 135-140, which effectively increase the width of zones 155 and 160 at defined points along the length of sidewalls 120 and 125.

To remove one of products 105 from sleeve 100 through first or second end opening 145, 150, the consumer pushes inward on the desired product 105 toward biasing beam 130. This compresses biasing beam 130 and expands the width of whichever zone 155, 160 that particular product 105 is located in until the width of that zone 155, 160 is greater than or equal to the width of products 105. At this point, the desired product 105 can be slid within its zone 155, 160 and out through first or second end opening 145, 150. Once the consumer is no longer compressing biasing beam 130 by pushing inward on one of products 105, biasing beam 130 automatically expands, ensuring that the remaining products 105 are held within openings 135-140. It should be understood though that biasing beam 130 is not typically compressed along its entire length when the consumer pushes inward on a single product 105. Instead, only a portion of biasing beam 130 adjacent to that product 105 is compressed. As a result, other products 105 can remain securely held during removal.

Depending on the configuration of sleeve 100, biasing beam 130 may not need to be fully compressed for the consumer to be able to slide one of products 105 within first or second zone 155, 160. Also, biasing beam 130 does not need to be in the fully expanded state when holding products 105 in openings 135-140. In other words, during use, biasing beam 130 can be converted between a first partially expanded/compressed state and a second partially expanded/compressed state (with one of these states being more expanded or compressed than the other) rather than between a fully expanded state and a fully compressed state while still functioning as intended. This allows for extra tolerance in the dimensions of sleeve 100, which is advantageous when mass producing sleeve 100.

In addition to applying force to products 105, biasing beam 130 increases the rigidity of sleeve 100, thereby providing reinforcement which helps prevent sleeve 100 from deforming. Biasing beam 130 also serves to separate products 105 in first zone 155 from products 105 in second zone 160, preventing products 105 from riding up on one another. Both sleeve deformation and riding of products 105 on one another can lead to products 105 shifting within and prematurely exiting sleeve 100. Accordingly, it should be recognized that biasing beam 130 helps retain products 105 within sleeve 100 in multiple ways.

Figure 2:
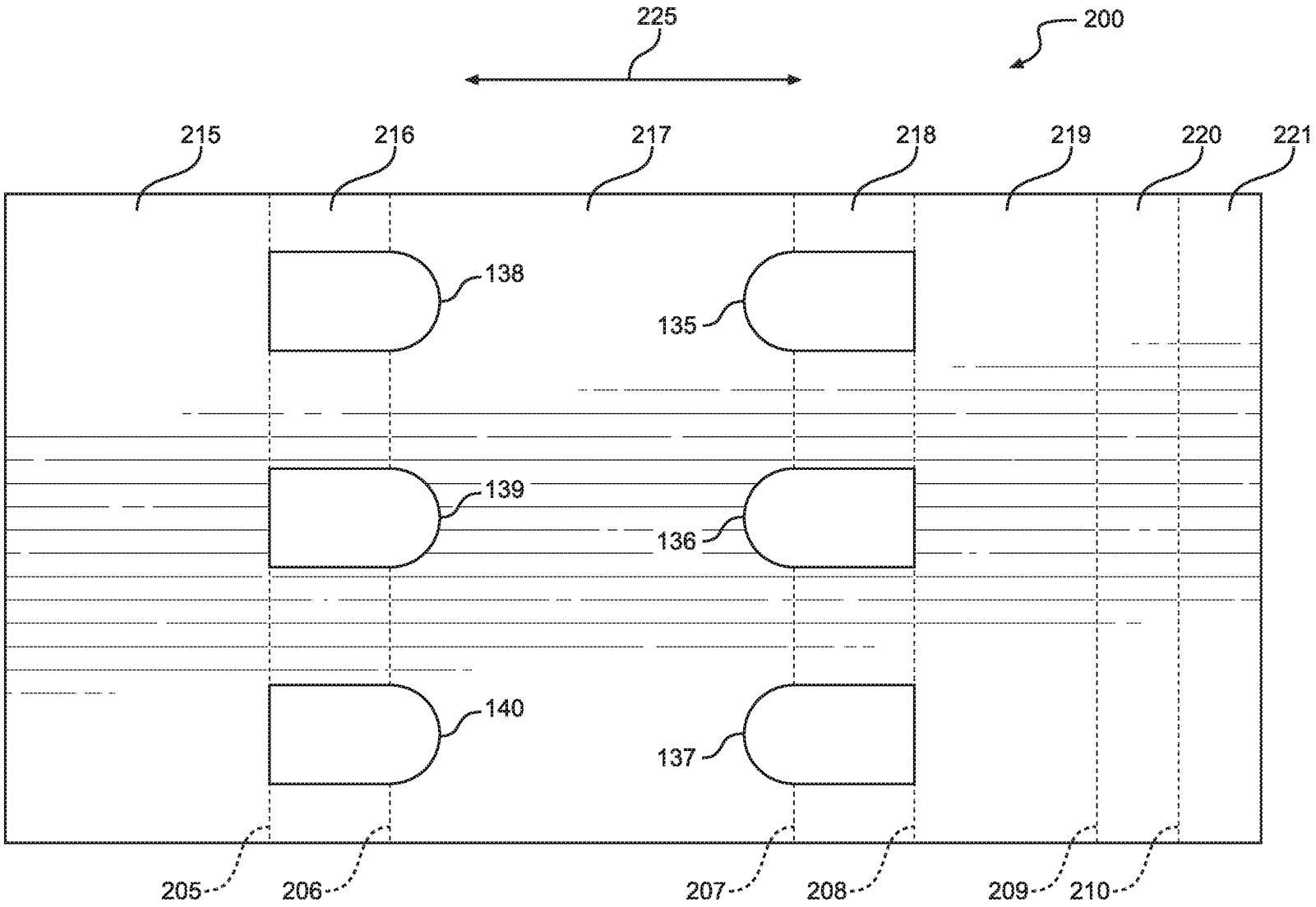
FIG. 2 is a top view of a blank from which the packaging sleeve of FIG. 1 is assembled.
Figure 3:
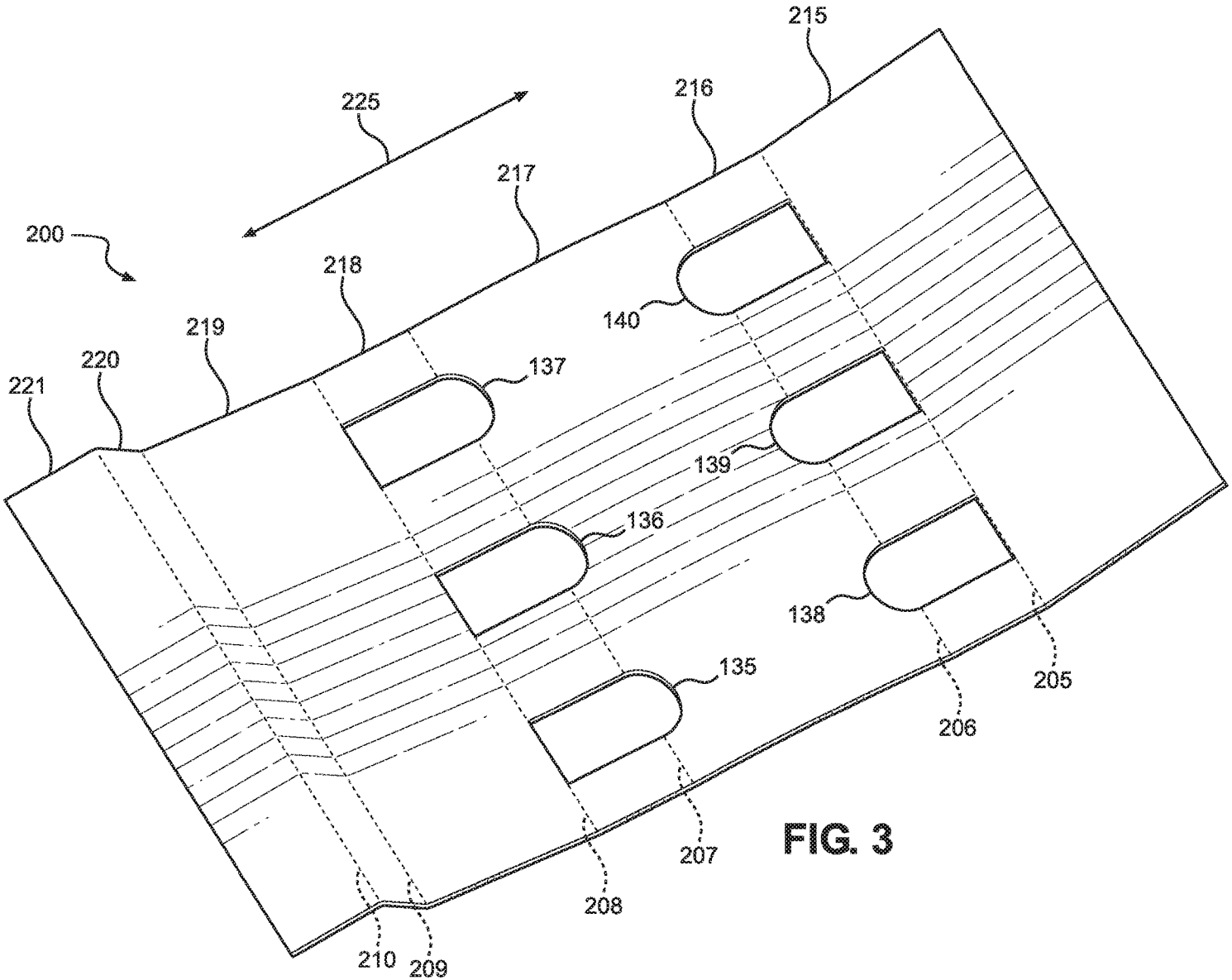
FIG. 3 is a perspective view of the blank in a partially folded state.

With reference now to FIG. 2, there is shown a blank 200 from which sleeve 100 is assembled. Openings 135-140 can be seen. In addition, blank 200 includes a plurality of score lines 205-210, which define a plurality of portions 215-221. When blank 200 is folded along score lines 205-210 to assemble sleeve 100, portions 215-221 form top wall 110, bottom wall 115, first sidewall 120, second sidewall 125 and biasing beam 130. Specifically, portions 215 and 219 form bottom wall 115, portion 216 forms second sidewall 125, portion 217 forms top wall 110, portion 218 forms first sidewall 120 and portions 220 and 221 form biasing beam 130. FIG. 3 shows blank 200 in a partially folded state to help illustrate this. Preferably, blank 200 is constructed from paperboard, with the fibers of the paperboard oriented in a direction 225 such that they are perpendicular to score lines 205-210. This arrangement has been found to provide the desired spring action for biasing beam 130 when blank 200 is folded to assemble sleeve 100.

Figure 4:
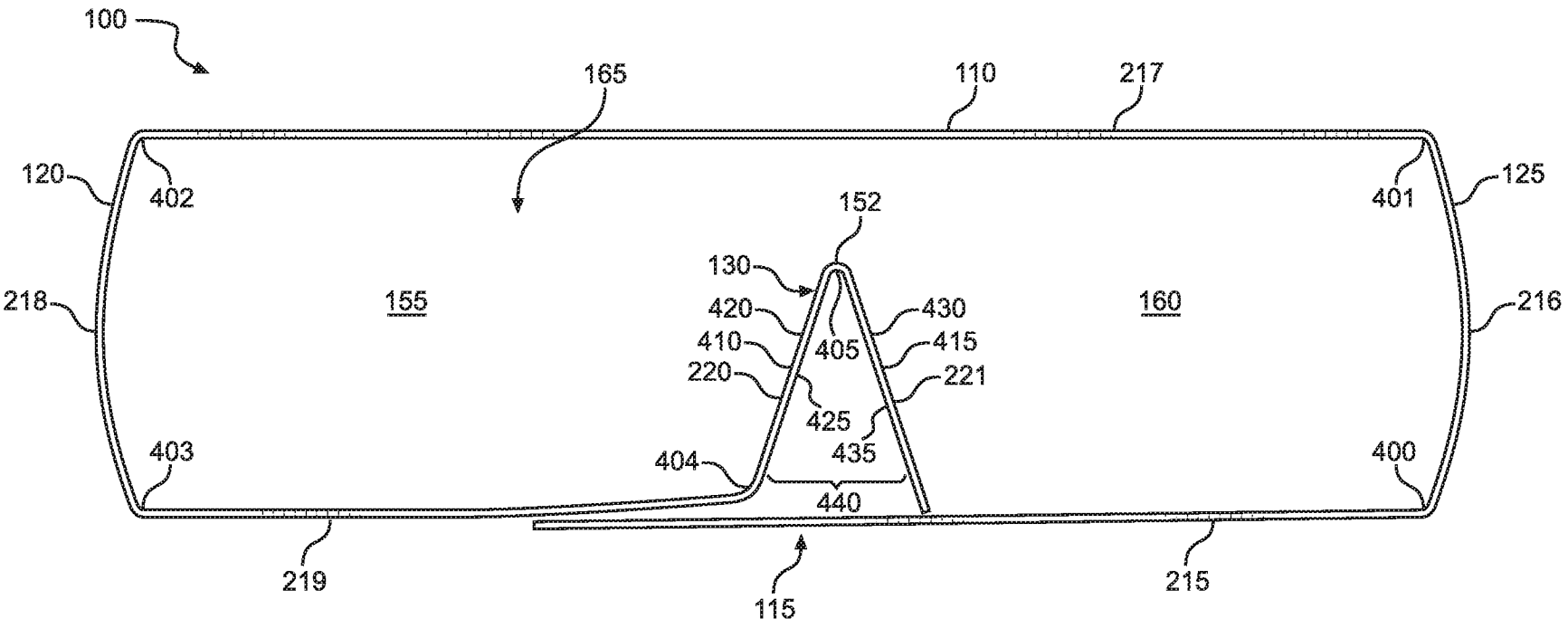
FIG. 4 is an end view of the packaging sleeve.

Turning to FIG. 4, an end view of sleeve 100 is provided to help show how folding portions 215-221 of blank along score lines 205-210 leads to the assembly of sleeve 100. This view also highlights the structure of biasing beam 130. Although score lines 205-210 are not visible in this view, it should be recognized that score line 205 is located in a corner 400, score line 206 is located in a corner 401, score line 207 is located in a corner 402, score line 208 is located in a corner 403, score line 209 is located in a corner 404, and score line 210 is located in a corner 405.

As noted above, portions 215 and 219 together form bottom wall 115. For purposes of the present invention, it is not necessary that each wall of sleeve 100 be formed as a single piece. Instead, given that blank 200 has two ends, it should be recognized that one of the walls of sleeve 100 will be formed from multiple pieces, with these pieces being attached to one another using an adhesive, or ultrasonic welding, for example. In the embodiment illustrated, portions 215 and 219 are attached to one another. However, the multi-piece wall does not need to be bottom wall 115 but can be any of the other walls, e.g., top wall 110 or first sidewall 120.

As also shown in FIG. 4, biasing beam 130 includes a first wall 410, formed by portion 220, and a second wall 415, formed by portion 221. First wall 410 has a first side 420 and a second side 425, while second wall 415 has a first side 430 and a second side 435. First sides 420 and 430 are configured to contact products 105 (not shown in this figure). Second sides 425 and 435 define a gap 440, of varying dimension, between first wall 410 and second wall 415. In the fully expanded state shown in FIG. 4, first wall 410 and second wall 415 are not in contact. In the fully compressed state, first wall 410 and second wall 415 would be in contact with one another. As discussed above, there are also a range of intermediate states, i.e., partially compressed/expanded states, where the width of gap 440 is smaller than in the fully expanded state. Depending on the configuration of sleeve 100 and the size of products 105, the consumer may either partially or fully compress biasing beam 130 when removing one of products 105 from sleeve 100. In any case, biasing beam 130 will be in a partially compressed/expanded state when products 105 are retained within sleeve 100.

Figure 5:
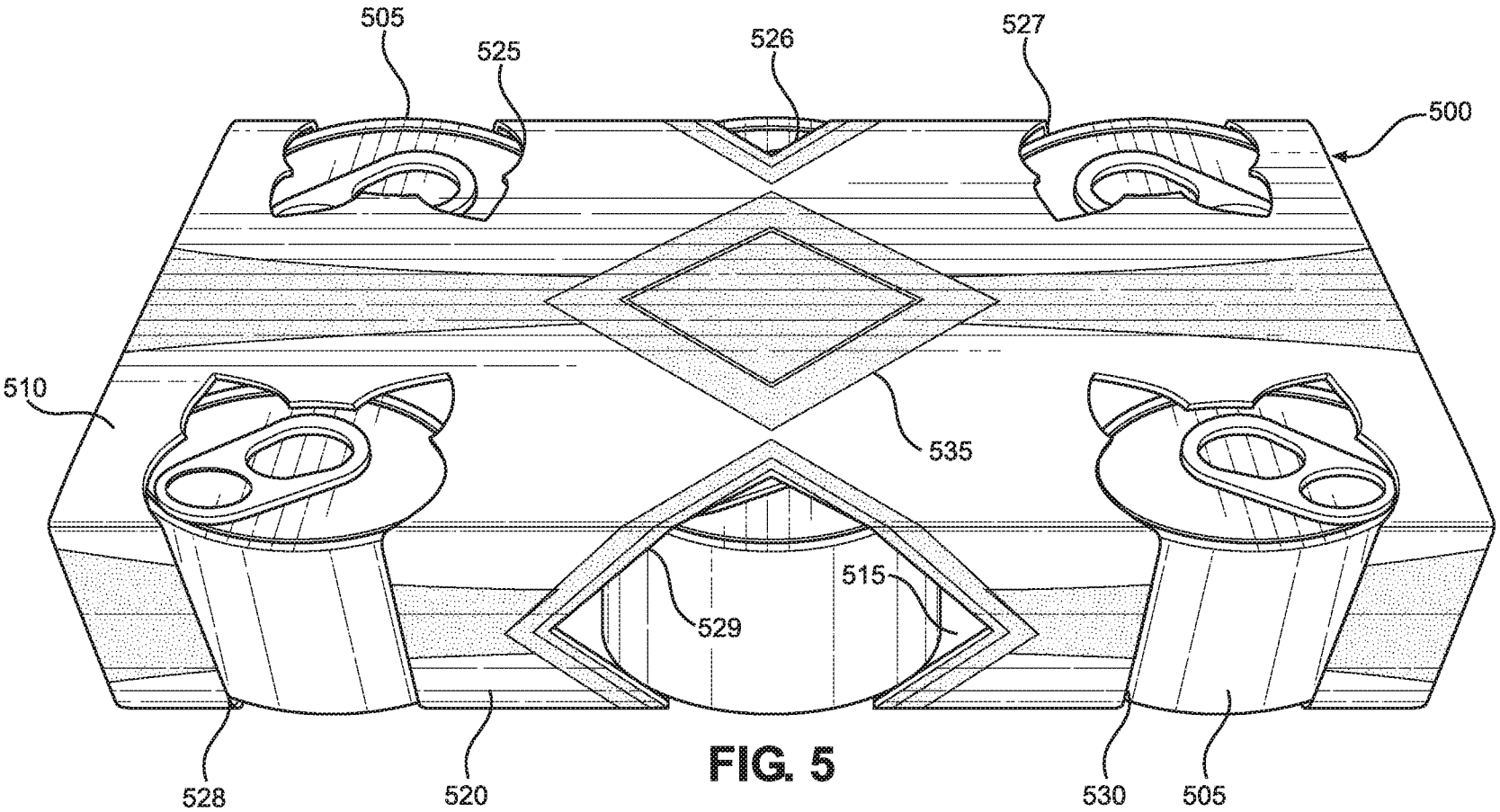
FIG. 5 is a perspective view of a packaging sleeve constructed in accordance with a second embodiment of the present invention.

With reference now to FIG. 5, a second embodiment of the present invention is shown. Like sleeve 100, a packaging sleeve 500 is configured to retain a plurality of individually packaged products 505. Sleeve 500 includes a top wall 510, a bottom wall 515, a first sidewall (not visible), a second sidewall 520 and a biasing beam (not visible). The first sidewall includes a plurality of openings 525-527, while second sidewall 520 includes a plurality of openings 528-530.

The only differences between sleeves 100 and 500 relate to the shape of openings 525-530 and the additional design elements visible on top wall 510 and second sidewall 520. These changes do not affect how sleeve 500 retains products 505 but are instead provided for branding and aesthetic purposes. Specifically, a diamond-shaped logo 535 is located on top wall 510. Openings 526 and 529 are shaped as diamonds to match logo 535. Of course, the shape of logo 535 and openings 526 and 529 can vary depending on the branding or aesthetics desired. In addition, openings 525, 527, 528 and 530 are shaped to represent cats to indicate that products 505 contain cat food. Similar to logo 535 and openings 526 and 529, the shape of openings 525, 527, 528 and 530 can vary depending on the contents of products 505 or, alternatively, the branding or aesthetics desired. It should also be recognized that the positioning of the diamond and cat shapes can be modified, e.g., opening 526 can be cat-shaped and openings 525 and 527 can be diamond-shaped. Furthermore, it is not necessary that some of openings 525-530 be shaped to match a logo provided on sleeve 500 while other of openings 525-530 are shaped to indicate the contents of products 505. One or the other can be chosen. There are many acceptable possibilities and combinations for the shape of openings provided in sleeves of the present invention.

Figure 6:
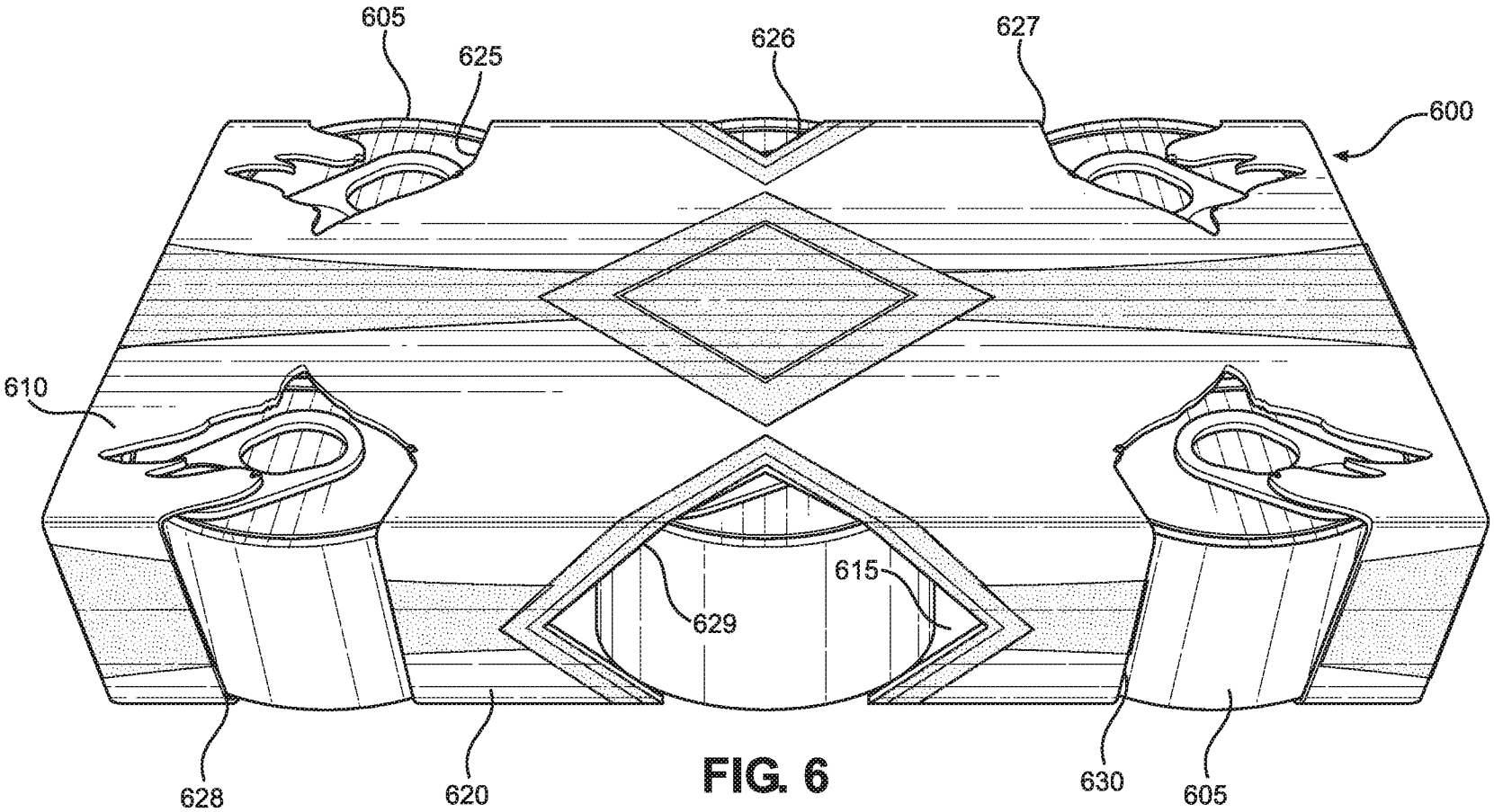
FIG. 6 is a perspective view of a packaging sleeve constructed in accordance with a third embodiment of the present invention.

To help illustrate this, FIG. 6 shows a third embodiment of the present invention in which a packaging sleeve 600 is constructed in a substantially identical manner to sleeve 500. That is, sleeve 600 is configured to retain a plurality of individually packaged products 605. Sleeve 600 includes a top wall 610, a bottom wall 615, a first sidewall (not visible), a second sidewall 620 and a biasing beam (not visible). The first sidewall includes a plurality of openings 625-627, while second sidewall 620 includes a plurality of openings 628-630. Rather than some of openings 625-630 being cat-shaped, openings 625, 627, 628 and 630 are shaped to represent dogs to indicate that products 605 contain dog food. Otherwise, sleeve 600 is identical to sleeve 500.

Figure 7:
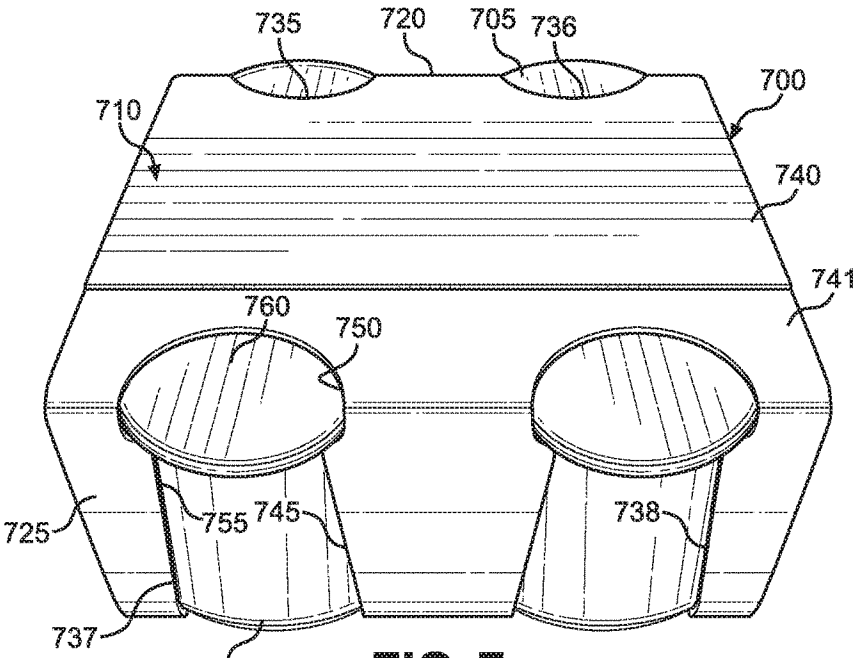
FIG. 7 is a perspective view of a packaging sleeve constructed in accordance with a fourth embodiment of the present invention.
Figure 8:
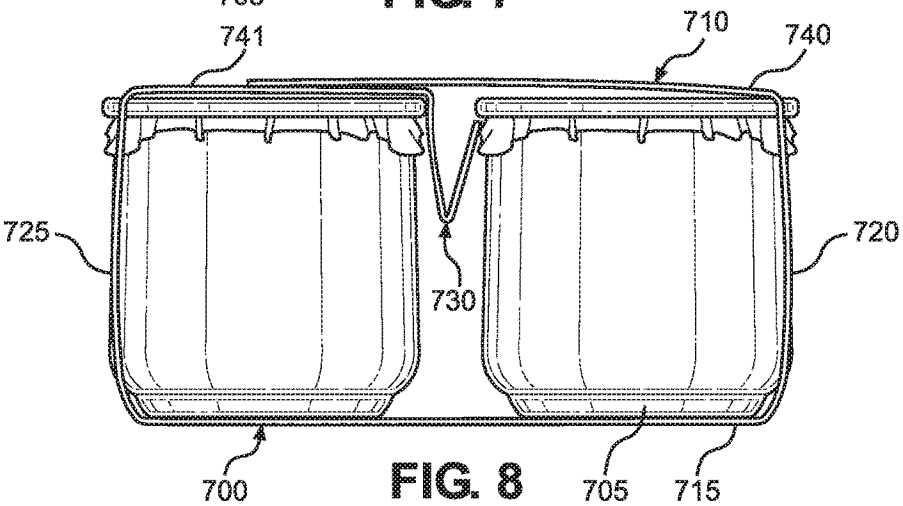
FIG. 8 is an end view of the packaging sleeve of FIG. 7.

With reference now to FIGS. 7 and 8, a fourth embodiment of the present invention is shown. Like sleeve 100, a packaging sleeve 700 is configured to retain a plurality of individually packaged products 705. In the embodiment illustrated, products 705 take the form of jars, such as yogurt jars. Sleeve 700 includes a top wall 710, a bottom wall 715, a first sidewall 720, a second sidewall 725 and a biasing beam 730. Top wall 710 and bottom wall 715 connect first sidewall 720 and second sidewall 725 to one another. In addition, bottom wall 715 is configured to supports products 705. First sidewall 720 includes openings 735 and 736, while second sidewall 725 includes openings 737 and 738. Each of openings 735-738 is configured to partially receive one of products 705. Biasing beam 730 is configured to bias products 705 into openings 735-738 by applying a force to each of products 705 in a direction toward openings 735-738. This holds products 705 in openings 735-738 such that sleeve 700 can effectively retain products 705.

Sleeve 700 functions in the same manner as sleeve 100 and is constructed similarly. The differences between sleeves 100 and 700 primarily relate to the location of biasing beam 730 and the shape of openings 735-738. In addition, the size of sleeve 700 is different since sleeve 700 is configured to retain four jars instead of six cans. Regarding biasing beam 730, biasing beam 730 extends downward from top wall 710 rather than extending upward from bottom wall 715. As a result, like bottom wall 115, top wall 710 is formed from two pieces (labeled 740 and 741).

Regarding openings 735-738, each opening has a relatively narrower portion and a relatively wider portion located adjacent to one another such that a lid of a corresponding product 705 extends through the relatively wider portion and the edge of the opening hooks under the lid to help hold that product 705 in place. For example, opening 737 has a first portion 745 that is relatively narrower and a second flared portion 750 that is relatively wider. At the points where portions 745 and 750 meet, an edge 755 of opening 737 hooks under a lid 760 of the product 705 that is received in opening 737.

Figure 9:
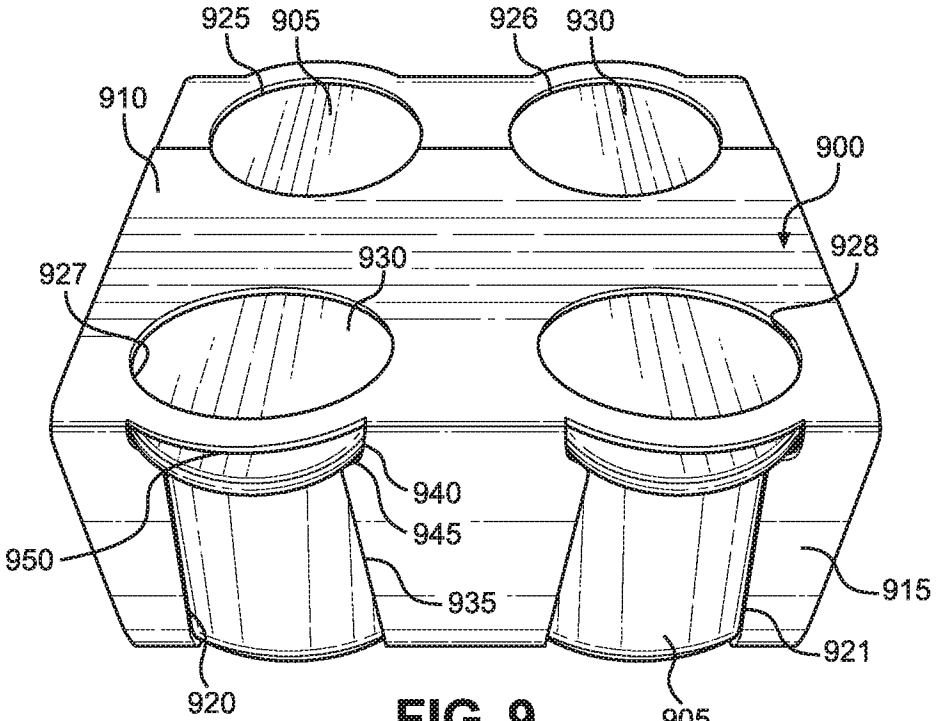
FIG. 9 is a perspective view of a packaging sleeve constructed in accordance with a fifth embodiment of the present invention.

Turning to FIG. 9, a fifth embodiment of the present invention is shown in which a packaging sleeve 900 is constructed in a substantially identical manner to sleeve 700. The only difference between sleeves 700 and 900 relates to the openings formed in sleeve 900. Accordingly, like sleeve 700, sleeve 900 is configured to retain a plurality of individually packaged products 905. Sleeve 900 includes a top wall 910, a bottom wall (not visible), a first sidewall (not visible), a second sidewall 915 and a biasing beam (not visible). Second sidewall 915 includes openings 920 and 921. Each of openings 920 and 921 is configured to partially receive one of products 905. The first sidewall is constructed in the same manner as second sidewall 915 and includes matching openings, which are not visible. In addition, top wall 910 includes openings 925-928 so that consumers can view lids 930 of products 905, which are typically provided with product information (not shown). The biasing beam is configured to bias products 905 into openings 920 and 921 (as well as the openings in the first sidewall) by applying a force to each of products 905.

Similar to openings 735-738 of sleeve 700, each sidewall opening in sleeve 900 has a relatively narrower portion and a relatively wider portion located adjacent to one another such that a lid of a corresponding product 905 extends through the relatively wider portion and the edges of the opening grip the lid to help hold that product 905 in place. For example, opening 920 has a first portion 935 that is relatively narrower and a second flared portion 940 that is relatively wider. Opening 920 also has a first edge 945 and a second edge 950, with flared portion 940 being defined, at least in part, by first and second edges 945, 950. Flared portion 940 is configured to grip lid 930 of the product 905 that is received in opening 920 between first and second edges 945, 950.

Figure 10:
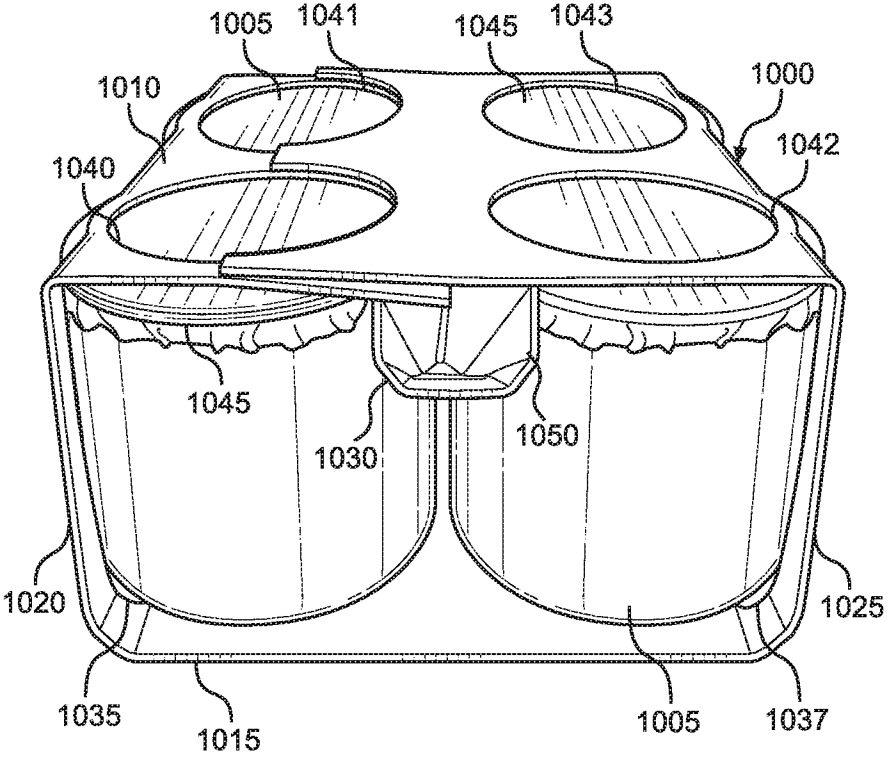
FIG. 10 is a perspective view of a packaging sleeve constructed in accordance with a sixth embodiment of the present invention.

With reference now to FIG. 10, a sixth embodiment of the present invention is shown. In particular, FIG. 10 shows a packaging sleeve 1000 that is constructed in substantially the same manner as packaging sleeve 900. Accordingly, like sleeve 900, sleeve 1000 is configured to retain a plurality of individually packaged products 1005. Sleeve 1000 includes a top wall 1010, a bottom wall 1015, a first sidewall 1020, a second sidewall 1025 and a biasing beam 1030. First sidewall 1020 includes two openings 1035 and 1036, while second sidewall 1025 includes two openings 1037 and 1038, although only openings 1035 and 1037 are visible in FIG. 10. Each of openings 1035-1038 is configured to partially receive one of products 1005. In addition, top wall 1010 includes openings 1040-1043 so that consumers can view lids 1045 of products 1005. Biasing beam 1030 is configured to bias products 1005 into openings 1035-1038 by applying a force to each of products 1005.

The main difference between sleeves 900 and 1000 relates to their respective biasing beams. Specifically, the biasing beam of sleeve 900 is the same as biasing beam 730 of sleeve 700. Like biasing beam 130 of sleeve 100, biasing beam 730 has a uniform geometry (generally V-shaped) and width along its length in the fully expanded state. That is, in the fully expanded state, the size of the gap between the walls of biasing beams 130 and 730 is uniform along the length of biasing beams 130 and 730. In contrast, biasing beam 1030 of sleeve 1000 has flared ends such that the width of biasing beam 1030 varies along its length. This is done to further aid in retaining products 1005 within sleeve 1000.

In particular, biasing beam 1030 has a first end 1050, a second end 1055 and an intermediate portion 1060 extending between first end 1050 and second end 1055, although only first end 1050 is visible in FIG. 10. Comparing FIGS. 8 and 10, it can be seen that first end 1050 of biasing beam 1030 is wider than biasing beam 730. However, first end 1050 tapers into sleeve 1000 to a sufficient degree that intermediate portion 1060 has a width similar to that of biasing beam 730. This is because intermediate portion 1060 is constructed like biasing beams 130 and 730, as can be seen in FIG. 11, and accordingly functions in the same manner.

Figure 11:
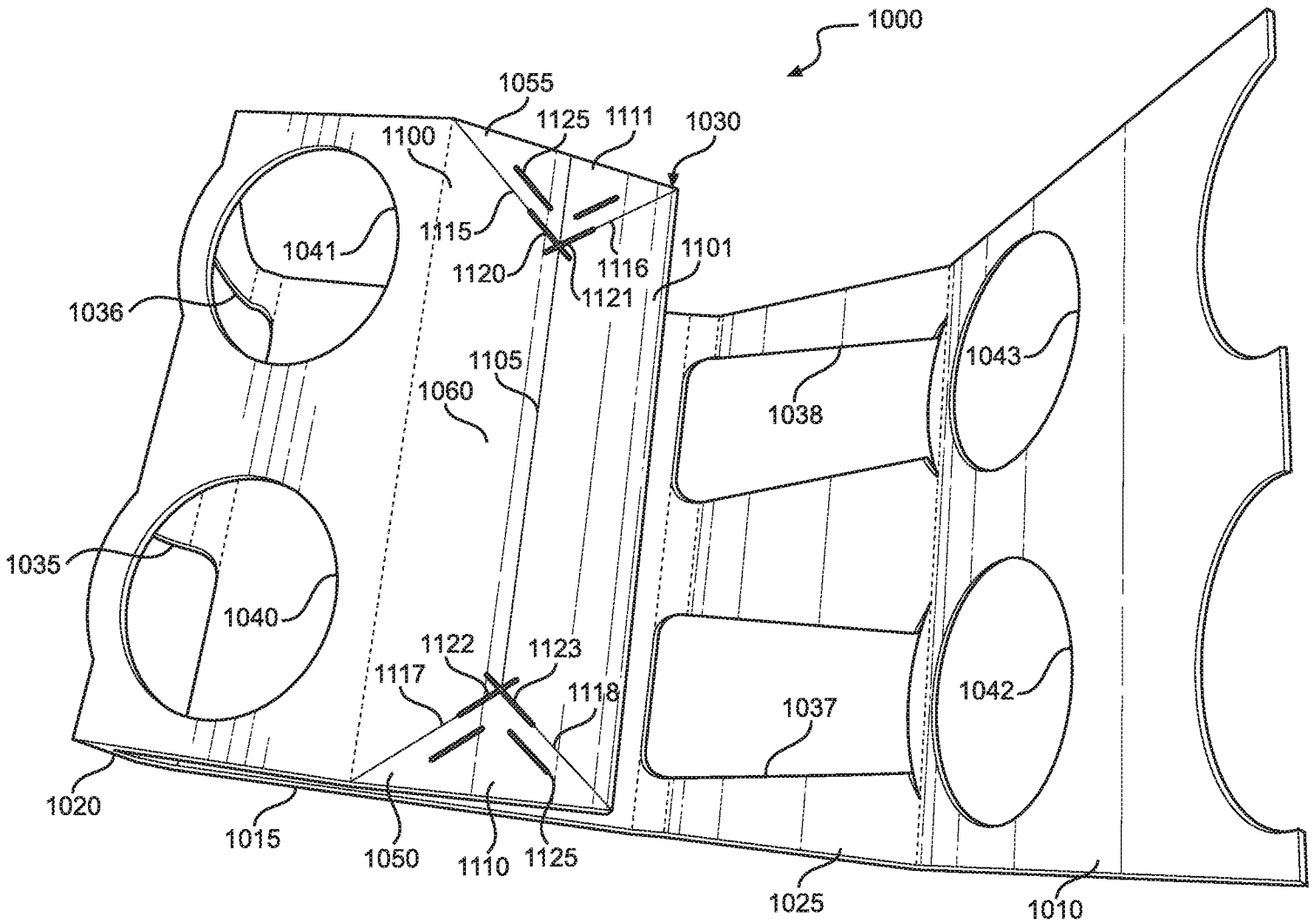
FIG. 11 is a perspective view of a blank from which the packaging sleeve of FIG. 10 is assembled, with the blank in a partially folded state.
Figure 12:
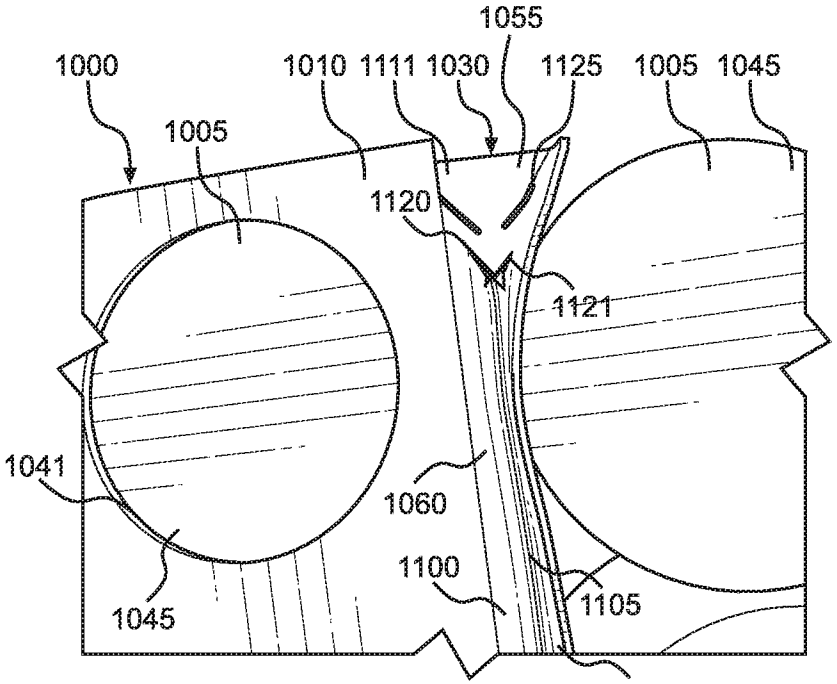
FIG. 12 is a top view of the packaging sleeve of FIG. 10 in a partially assembled state.

In FIG. 11, sleeve 1000 is shown in a partially folded state, and second end 1055 and intermediate portion 1060 (along with openings 1036 and 1038) are now visible. Intermediate portion 1060 is essentially formed from two walls, corresponding to a first panel 1100 and a second panel 1101, which are joined at a score line 1105. Biasing beam 1030 in joined to part of top wall 1010 by a score line 1106. It should be recognized that these aspects of biasing beam 1030 make it quite similar to biasing beam 130. Where biasing beams 130 and 1030 differ is in ends 1050 and 1055. First end 1050 is formed from a triangular panel 1110, while second end 1055 is formed from a triangular panel 1111. Panels 1110 and 1111 are joined to panels 1100 and 1101 by angled score lines 1115-1118 and angled slits 1120-1123. In addition, each of panels 1110 and 1111 has a pair of slits 1125 in its interior. This structure allows ends 1050 and 1055 to bend and form flared ends when biasing beam 1030 is folded, while intermediate portion 1060 forms a V-shaped channel, as shown in FIG. 12 where a gap 1200 is defined between panels 1100 and 1101. The width of gap 1200 is greater in first and second ends 1050, 1055 than in intermediate portion 1060. This makes it more difficult for products 1005 to exit sleeve 1000 unintentionally.

Although the sleeves of the present invention have been described in connection with cans and jars, the sleeves are not limited to retaining such types of packaging. Nor are the sleeves limited to retaining food products. In addition, while the products illustrated have been round, products having other shapes can certainly be retained within the sleeves, e.g., hexagonal, octagonal or other polygonal products. Furthermore, while the sleeves described above are shown to have two zones for products, sleeves with different numbers of zones, including a sleeve with a single zone or three or more zones (with multiple biasing beams) could be employed. Finally, although the product receiving opening in certain embodiments have been shown shaped reminiscent of a cat or dog, other animate or even inanimate objects could be presented.

Based on the above, it should be readily apparent that the present invention provides a sleeve for individually packaged products that allows a product to be removed from the sleeve without affecting the ability of the sleeve to retain the remaining products. In addition, the products within the sleeve are visible from outside the sleeve, allowing a consumer to easily see the number and size of the products. While certain preferred embodiments of the present invention have been set forth, it should be understood that various changes or modifications could be made without departing from the spirit of the present invention. In general, the invention is only intended to be limited by the scope of the following claims.

The invention claimed is:

1. A retail packaged product comprising:

a plurality of individually packaged products; and a packaging sleeve configured to retain the plurality of individually packaged products and to remain intact upon removing one or more of the plurality of products therefrom, the packaging sleeve including:

a plurality of walls together defining an interior of the packaging sleeve, the plurality of walls including a first wall having a first opening configured to partially receive a first product of the plurality of individually packaged products; and a biasing beam located within the interior and configured to exhibit a spring action to bias the first product into the first opening by applying a force to the first product in a direction toward the first opening, wherein the biasing beam is configured to a) assume a first, partially compressed state when biasing the first product into the first opening of the packaging sleeve, b) compress into a second compressed state, which is more compressed than the first, partially compressed state, to remove the first product, and c) automatically expand from the second compressed state, without tearing the packaging sleeve such that the packaging sleeve remains intact, after removal of the first product from the packaging sleeve, wherein the packaging sleeve is constructed from a paperboard material containing fibers which are oriented to cross a bend or fold in the biasing beam such that the biasing beam is biased to a fully expanded state.

2. The retail packaged product of claim 1, wherein the first wall constitutes a first sidewall of the packaging sleeve, and the plurality of walls further includes:

a second sidewall arranged opposite the first sidewall and having a second opening configured to partially receive a second product of the plurality of individually packaged products;

a bottom wall connecting the first and second sidewalls and configured to support the plurality of individually packaged products; and a top wall connecting the first and second sidewalls, and wherein:

the biasing beam is configured to also bias the second product into the second opening by applying a force to the second product in a direction toward the second opening;

the first sidewall, second sidewall, bottom wall and top wall together define a first end opening and a second end opening through which the plurality of individually packaged products can be removed;

the first sidewall, bottom wall, top wall and biasing beam together define a first zone configured to retain the first product; and the second sidewall, bottom wall, top wall and biasing beam together define a second zone configured to retain the second product.

3. The retail packaged product of claim 2, wherein the biasing beam includes a first beam wall and a second beam wall, the first beam wall of the biasing beam is configured to contact the first product, and the second beam wall of the biasing beam is configured to contact the second product.

4. The retail packaged product of claim 2, wherein at least a portion of each of the first and second openings is shaped reminiscent of an animate object.

5. The retail packaged product of claim 1, wherein the biasing beam is convertible between a fully compressed state and the fully expanded state, the biasing beam includes a first beam wall and a second beam wall, and the first and second beam walls of the biasing beam are closer together when the biasing beam is in the fully compressed state than when the biasing beam is in the fully expanded state.

6. The retail packaged product of claim 5, wherein the biasing beam is V-shaped in cross-section.

7. The retail packaged product of claim 5, wherein the biasing beam has a first flared end, a second flared end and an intermediate portion extending between the first and second flared ends such that a width of the biasing beam varies along a length of the biasing beam.

8. The retail packaged product of claim 1, wherein the first opening has a first edge, a second edge and a flared portion defined, at least in part, by the first and second edges, and the flared portion is configured to grip part of the first product between the first and second edges.

9. A packaging sleeve configured to retain a plurality of individually packaged products and to remain intact upon removing one or more of the plurality of products therefrom, the packaging sleeve comprising:

a plurality of walls together defining an interior of the packaging sleeve, the plurality of walls including a first wall having a first opening configured to partially receive a first product of the plurality of individually packaged products; and a biasing beam located within the interior and configured to exhibit a spring action to bias the first product into the first opening by applying a force to the first product in a direction toward the first opening, wherein the biasing beam is configured to a) assume a first, partially compressed state when biasing the first product into the first opening of the packaging sleeve, b) compress into a second compressed state, which is more compressed than the first, partially compressed state, to remove the first product, and c) automatically expand from the second compressed state, without tearing the packaging sleeve such that the packaging sleeve remains intact, after removal of the first product from the packaging sleeve, wherein the packaging sleeve is constructed from a paperboard material containing fibers which are oriented such that the biasing beam is biased to a fully expanded state by orienting the fibers so that the fibers cross a bend or fold in the biasing beam.

10. The packaging sleeve of claim 9, wherein the first wall constitutes a first sidewall of the packaging sleeve, and the plurality of walls further includes:

a second sidewall arranged opposite the first sidewall and having a second opening configured to partially receive a second product of the plurality of individually packaged products;

a bottom wall connecting the first and second sidewalls and configured to support the plurality of individually packaged products; and a top wall connecting the first and second sidewalls, and wherein:

the biasing beam is configured to bias the second product into the second opening by applying a force to the second product in a direction toward the second opening;

the first sidewall, second sidewall, bottom wall and top wall together define a first end opening and a second end opening through which the plurality of individually packaged products can be removed;

the first sidewall, bottom wall, top wall and biasing beam together define a first zone configured to retain the first product; and the second sidewall, bottom wall, top wall and biasing beam together define a second zone configured to retain the second product.

11. The packaging sleeve of claim 10, wherein the biasing beam extends from the first end opening to the second end opening.

12. The packaging sleeve of claim 9, wherein the biasing beam is convertible between a fully compressed state and the fully expanded state, the biasing beam includes a first beam wall and a second beam wall, and the first and second beam walls of the biasing beam are closer together when the biasing beam is in the fully compressed state than when the biasing beam is in the fully expanded state.

13. The packaging sleeve of claim 12, wherein the biasing beam is V-shaped.

14. The packaging sleeve of claim 12, wherein the biasing beam has a first flared end, a second flared end and an intermediate portion extending between the first and second flared ends such that a width of the biasing beam varies along a length of the biasing beam.

15. The packaging sleeve of claim 9, wherein the first opening has a first edge, a second edge and a flared portion defined, at least in part, by the first and second edges, and the flared portion is configured to grip part of the first product between the first and second edges.

16. A method of retaining and selectively removing a plurality of individually packaged products with a packaging sleeve including a plurality of walls and a biasing beam, wherein the plurality of walls together defines an interior of the packaging sleeve, the plurality of walls includes a first wall having a first opening, the biasing beam is located within the interior, the biasing beam is configured to exhibit a spring action and the packaging sleeve is constructed from a paperboard material containing fibers which are oriented such that the biasing beam is biased to a fully expanded state with the fibers being oriented to cross a bend or fold in the biasing beam, the method comprising:

partially receiving a first product of the plurality of individually packaged products within the first opening;

biasing the first product into the first opening with the biasing beam by compressing the biasing beam into a first partially compressed state and applying a force to the first product in a direction toward the first opening to retain the first product;

to remove the first product, pushing the first product in a direction opposite the force applied by the biasing beam, to compress the biasing beam into a second compressed state that is more compressed than the first partially compressed state; and removing the first product from the packaging sleeve without a need to tear the packaging sleeve, whereupon, after the first product is removed, the biasing beam automatically expands.

17. The method of claim 16, wherein the biasing beam includes a first beam wall and a second beam wall, with the first beam wall of the biasing beam contacting the first product within the interior of the packaging sleeve and the second beam wall of the biasing beam contacting a second product of the plurality of individually packaged products in biasing the second product into a second opening of the packaging sleeve.

* * * * *